US007559731B2

(12) United States Patent
Gretsch et al.

(10) Patent No.: US 7,559,731 B2
(45) Date of Patent: Jul. 14, 2009

(54) DEPOT FOR MATERIAL ROLLS, MATERIAL SUPPLY SYSTEM AND METHOD FOR STORING MATERIAL ROLLS

(75) Inventors: Harald Karl Gretsch, Eibelstadt (DE); Lothar Franz Hohmann, Erlabrunn (DE); Erwin Paul Josef Lehrieder, Gaukönigshofen (DE); Josef Herbert Olbort, Mainbernheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 514 days.

(21) Appl. No.: 10/545,900

(22) PCT Filed: Feb. 13, 2004

(86) PCT No.: PCT/EP2004/050126

§ 371 (c)(1),
(2), (4) Date: Aug. 17, 2005

(87) PCT Pub. No.: WO2004/071904

PCT Pub. Date: Aug. 26, 2004

(65) Prior Publication Data

US 2006/0182548 A1 Aug. 17, 2006

(30) Foreign Application Priority Data

Feb. 17, 2003 (DE) ..... 103 06 759

(51) Int. Cl.
*B65G 1/00* (2006.01)
*B65G 65/00* (2006.01)

(52) U.S. Cl. ..... 414/273; 414/279; 414/911

(58) Field of Classification Search ..... 259/559.3; 414/267, 273, 277, 279, 281, 282, 283, 347, 414/910, 911

See application file for complete search history.

(56) References Cited

U.S. PATENT DOCUMENTS

| | | | | |
|---|---|---|---|---|
| 3,559,822 | A * | 2/1971 | Lichtenford et al. | 414/140.3 |
| 4,634,332 | A * | 1/1987 | Kamide et al. | 414/273 |
| 5,076,751 | A | 12/1991 | Kafka | |
| 5,085,377 | A | 2/1992 | Rohrer et al. | |
| 5,582,497 | A * | 12/1996 | Noguchi | 414/281 |
| 5,876,172 | A * | 3/1999 | Di Rosa | 414/139.9 |
| 6,602,037 | B2 | 8/2003 | Winkler | |
| 2002/0021954 | A1 * | 2/2002 | Winkler | 414/273 |

FOREIGN PATENT DOCUMENTS

| | | |
|---|---|---|
| DE | 2 158 537 | 6/1971 |
| DE | 37 39 222 A1 | 5/1988 |
| DE | 37 39 234 A1 | 5/1988 |
| DE | 89 16 100.9 | 3/1989 |

(Continued)

*Primary Examiner*—Gregory W Adams
(74) *Attorney, Agent, or Firm*—Jones, Tullar & Cooper, P.C.

(57) ABSTRACT

A depot or a storage facility for a plurality of material rolls, which rolls are intended for further processing in a processing machine, includes two outer shelving blocks in addition to at least one inner shelving block that is situated between the two outer shelving blocks. A storage location of the inner shelving block can be loaded or unloaded by a retrieval device which can access the shelving block from both longitudinal sides of the shelving block.

9 Claims, 6 Drawing Sheets

FOREIGN PATENT DOCUMENTS

| | | | |
|---|---|---|---|
| DE | 39 10 444 | C2 | 10/1993 |
| DE | 44 16 213 | A1 | 11/1995 |
| DE | 100 57 735 | A1 | 10/2001 |
| EP | 0 334 366 | A2 | 9/1989 |
| EP | 0 390 735 | A2 | 3/1990 |
| EP | 559 604 | A1 | 9/1993 |
| EP | 0 861 797 | A1 | 3/1997 |

* cited by examiner

DEPOT FOR MATERIAL ROLLS, MATERIAL SUPPLY SYSTEM AND METHOD FOR STORING MATERIAL ROLLS

CROSS-REFERENCE TO RELATED APPLICATIONS

This application is the U.S. national phase, under 35 USC 371, of PCT/EP2004/050126, filed Feb. 13, 2004; published as WO 2004/071904 A2 and A3 on Aug. 26, 2004, and claiming priority to DE 103 06 759.0, filed Feb. 17, 2003, the disclosures of which are expressly incorporated herein by reference.

FIELD OF THE INVENTION

The present invention is directed to a depot for rolls of material, to a material supply system, as well as to methods for storing rolls of material . The rolls of material are intended for further processing in a web-processing machine.

BACKGROUND OF THE INVENTION

A device for supplying an installation, such as, in particular, a printing press, with material is known from DE 39 10 444 C2. Rolls of material are placed into intermediate storage in a buffer depot. The buffer depot has two shelf blocks, between which a stacking device is provided, which stacking device is configured for serving both of the shelf blocks.

DE 100 57 735 A1 discloses a system for providing articles, and having a plurality of parallel rows of shelves. Storage and pickup lanes are alternatingly located between the rows of shelves.

A storage system is disclosed in DE 21 58 537 A. Storage locations of a center row of shelves can be served from aisles adjoining both sides.

EP 0 334 366 A2 discloses three depot regions, namely a main depot, embodied as a stack-type depot; an intermediate depot; and a supply of rolls. In the intermediate depot, storage places in multiple rows side by side are provided, which storage places can be reached from above by a crane arrangement.

In DE 44 16 213 A1, a main depot and an intermediate depot are disclosed; the intermediate depot is embodied as a shelving depot. The intermediate depots are embodied as shelf blocks that can be accessed from one side.

SUMMARY OF THE INVENTION

The object of the present invention is directed to providing a depot for rolls of material, to a material supply system, as well as to methods for storing rolls of material.

In accordance with the present invention, this object is attained by the provision of a depot that receives rolls of material which are intended for further processing in a web-processing machine. The depot has at least two shelf blocks which extend substantially parallel to each other. A serving element is arranged between the two shelf blocks. Two outer shelf blocks are separated by at least one inner shelf block. The inner shelf block has storage space that can be accessed from either side.

The advantages to be gained by the present invention lie, in particular, in that by the use of the depot of the present invention a large degree of flexibility and supply, even during peak demands, is assured. The storage space which has to be reserved is optimized.

A configuration of several shelf blocks, which shelf blocks overlap, at least in sections, in the longitudinal direction, makes possible the delivery of rolls that are not yet prepared independently of the production process. It also facilitates the rapid forwarding of prepared rolls to a shelf block which is located closer to the printing press.

The embodiment of a shelf block that is located on the inside, for being accessible from both longitudinal sides, makes possible a very efficient redepositioning of the rolls between individual blocks. The storage and removal of a roll from an inside or interiorly located shelf block is not tied to a serving device of an aisle. Supplying of the shelf block can take place from one side, while a removal of material from the other side of the shelf block can take place simultaneously. Travel of the serving devices around the shelf block, and therefore the interference of serving devices with each other, can be avoided.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
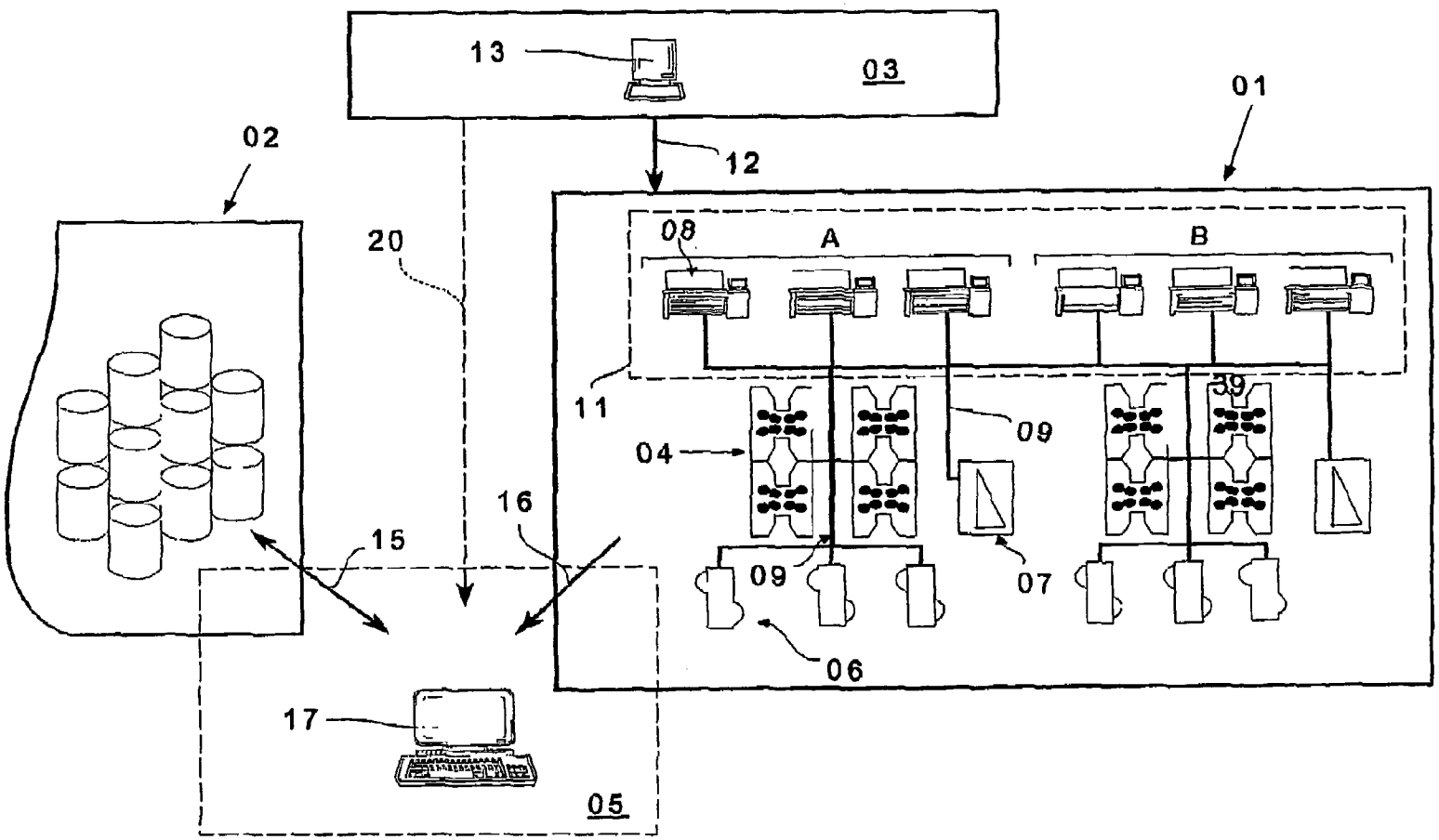
FIG. 1, a schematic representation of a print shop with a printing press and with a roll supply system, in FIG. 2, a top plan view of the device for material supply in a printing press installation in accordance with the present invention, in FIG. 3, a front elevation view of the device for material supply in accordance with FIG. 2, in FIG. 4, a flow chart of the method for storage of material rolls of the present invention, in FIG. 5, a sub-process for determining a storage strategy, and in FIG. 6, a sub-process for determining a redepositioning strategy in accordance with the present invention.

An installation which is intended for using and/or processing webs, such as, for example, a print shop, and which is represented schematically in FIG. 1, has, for example, at least one machine 01 using and/or processing webs, such as, for example, a printing press 01, a material supply system 02, such as, for example a roll supply system 02, as well as a product planning system 03, if desired. It also has, for example, a control system 05, which may be embodied as a material flow system 05 for use in coordinating and for assuring the supply of the installation with rolls.

The printing press 01 has at least one unit 04, which may be embodied as a printing unit 04 and/or as a printing tower 04, for imprinting a web, and which is supplied with material, such as, for example, paper, by at least one unit 06 that is embodied as a roll changer 06, which roll changer can be intended for operating only when the press is stopped or a roll changer that is usable for changing rolls at full press speed. The printing press can furthermore contain a unit 07, which is arranged downstream of the printing unit 04, in a direction of web travel, and which is intended for processing the imprinted web. This unit 07 can include, for example, at least one folding apparatus 07. The at least one printing unit 04, the at least one roll changer 06 and possibly also the at least one folding apparatus 07, are all connected, such as, for example, by at least one signal line 09, which may be, for example, an internal network 09 of the printing press, with at least one operating and computing unit 08, such as, for example, a control console with a PC.

As a rule, several, such as, for example, five or even more roll changers 06 are combined on a folding apparatus 07 for running a production. This combination of roll changers 06, with the associated printing units 04, or printing towers 04, is called a section A B. A printing press line consists of several sections A, B, respectively, for example, on which different productions can be run.

In the example of the present invention, which is represented in FIG. 1, the printing press 01 has two sections A, B, for example, each of which sections A, B is provided with two printing towers 04, with three roll changers 06, with three operating and computing units 08, as well as with a folding apparatus 07. In the embodiment of the invention depicted in FIG. 1, the roll changers 06, as well as the printing units 04 of each section, are connected via the signal line or network 09, for example. Via the signal line or network 09, there is provided a connection, either homogeneous or heterogeneous, between the sections A, B and/or between the operating and computing units 08. The folding apparatus 07 for each of the sections A, B, if provided, are also in connection with each other using this network 09, for example.

The operating and computing units 08, together with their transverse connection, as well as with possibly provided, but not specifically represented additional computing and data processing units, form a so-called management level 11, or a press management level 11 of the printing press 01. The management level 11 is, for example, in a signal connection 12 with, for example, a computing and/or data processing unit 13 of the production planning system 03. Production-relevant data, for example, is transferred, via this signal connection 12, from the product planning system 03 to the printing press 01.

In one embodiment of the present invention, the printing press 01 is, for example, in a signal connection 15, 16, in a suitable way, for example via the material flow system 05, with the roll supply system 02. Production-relevant data can be transferred, at least via the signal connection 16, from the printing press 01 to the material flow system 05, for example to at least one computing and/or data processing unit 17 of the material flow system 05. In addition, or alternatively, a transfer of this production-relevant data can also take place, by way of an optional signal connection 20, from the product planning system 03. If so provided, the material flow system 05 can, in principle, also be assigned to the roll supply system 02 or to the printing press 01 or, in an advantageous embodiment, within the scope of its tasks, can be of a higher order than the roll supply system 02 or the printing press 01.

Figure 2:
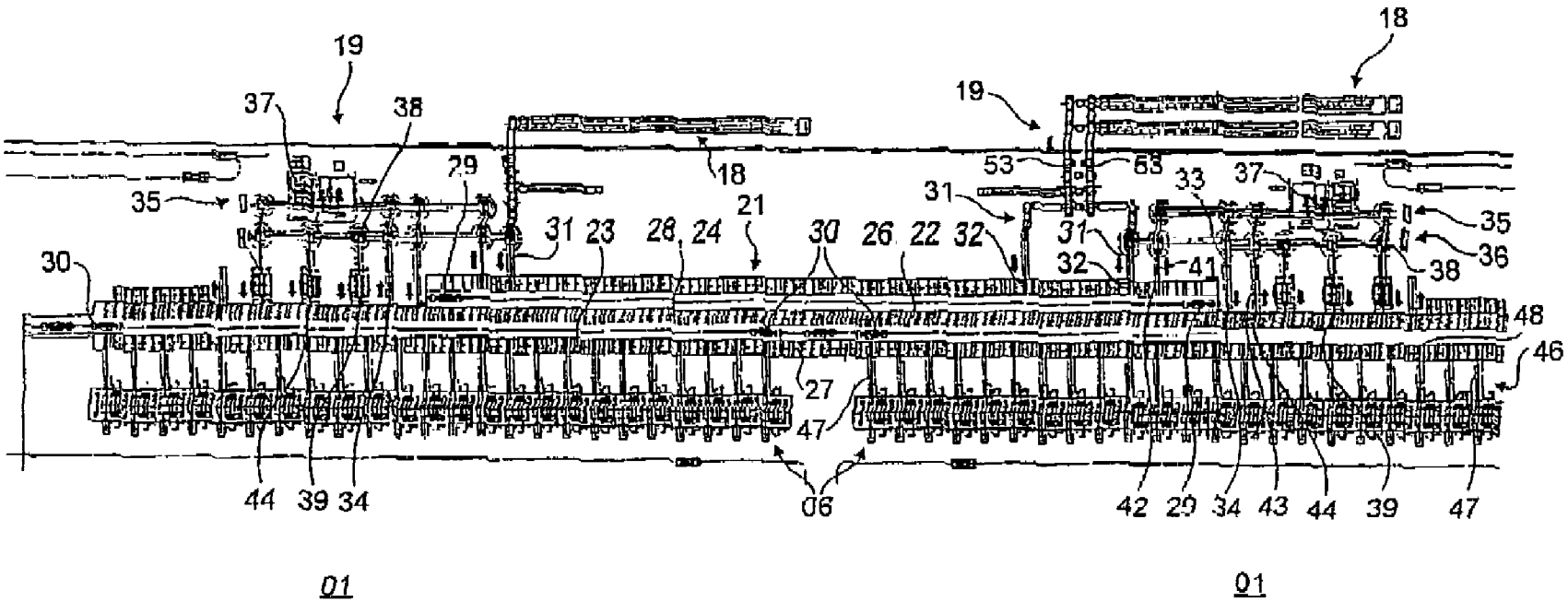

A possible configuration, by the use of hardware technology, of a roll supply system 02, is schematically represented in FIG. 2. However, in this roll supply system 02, not all of the subsystems which will be described in what follows need be present in a device in accordance with the invention and/or for the method in accordance with the invention. Individual functional subsystems can also be embodied in a manner different from that represented.

In the preferred embodiment of the present invention, in accordance with FIG. 2, the roll supply system 02 has, for example, at least one stock reception arrangement 18, a first transport system 19, as well as at least one depot 21, as its subsystems.

Viewed in the longitudinal direction, the depot 21 has at least three side-by-side arranged shelf blocks 22, 23, 24, which three shelf blocks partially overlap, at least in the longitudinal direction. These three shelf blocks consist of a first outer shelf block 22 that is located remote from the roll changers 06, a second outer shelf block 23 which is located next to the roll changers 06, and an inner or center shelf block 24 which is located between the two outer shelf blocks 22 and 23. In this case, an arrangement of adjoining, and in particular of aligned, storage spaces 26, 27, 28 are provided in these shelf blocks. In FIG. 2, only one storage space 26, 27, 28 is identified for each shelf block 22, 23, 24 and is understood to be a storage space of a shelf block 22, 23, 24, each of which can receive one roll, either oriented side-by-side or one above the other.

The center shelf block 24 is embodied in such a way that, in at least one area, a storage space 28 which is assigned to this center shelf block 24 can be served or accessed from both longitudinal sides of the center shelf block 24. To accomplish this end, in an advantageous embodiment, the shelf block 24 has only one such storage space 28 over its width in this area.

If several storage spaces 28 should be provided over the width of shelf block 24, care must be taken that only one of the storage spaces 28, arranged one behind the other, is located in the area provided for the purpose intended here, and that a serving device has the appropriate reach for moving a roll over an empty storage space 28.

Free spaces, for example corridors, which corridors are extending in the longitudinal direction between respectively two shelf blocks 22, 23, 24, are provided, and to each one of which corridors at least one transport system 29, 30, such as, for example, a shelf serving element 29, 30, is assigned. The shelf serving elements 29, 30, which are arranged between two shelf blocks 22, 23, 24, are preferably configured so that they can reach storage spaces 26, 27, 28 of both adjoining shelf blocks 22, 23, 24. The shelf serving elements 29, 30 are preferably configured in such a way that a tool, working together with the material rolls, has at least one degree of freedom in the horizontal direction along the corridor, at least one degree of freedom in the vertical direction and also in the horizontal direction transversely in respect to the corridor.

The transport system 19 has at least one transport track 31 from the delivery point to the depot 21. In particular, at least one transport track 31 is provided to a storage space 32 of the outer shelf block 22 , which is used, for example, as a transfer station 32 in the course of storing, or is configured in that way.

In a preferred embodiment of the present invention, the transport system 19 additionally has at least one transport track 33 extending to a storage space 34, which storage space 34 is acting, for example, as the transfer station 34, of the inner or central shelf block 24. For this purpose, the outer shelf block 22 has an access, such as, for example, a passage, or the outer shelf block 22 does not extend over the same length of the inner shelf block 24, such as is the case in the preferred embodiment depicted in FIG. 2. Rolls of material coming from the stock reception arrangement 18, such as, for example, not yet prepared material rolls, can be stored either in the outer shelf block 22 or in the inner shelf block 24.

In an advantageous embodiment of the present invention, the transport system 19 has, in addition, at least one transport track 36 over a so-called preparation circuit 35, which leads from the stock reception arrangement 18, via, for example, an unpacking station 37 and/or a glue preparation station 38, to a storage space 39, such as, for example, in the form of a transfer station 39, of the inner or center shelf block 24. For this purpose, the above mentioned access passage, or a shortening of the outer shelf block 22, is, for example, provided.

In a further development of the present invention, the transport tracks 31, 33 and/or 36 are connected with each other in such a way that a material roll, which had already been prepared in the unpacking station 37 and/or the glue preparation station 38, can be moved to the storage space 32 of the outer shelf block 22.

In an advantageous further development of the present invention, the transport system 19 has a transport track 41, which is different from at least the transport track 36, on which material rolls from a storage space 42, such as, for example, in the form of a transfer station 42 of the outer shelf block 22, can again be placed on the transport tracks 31, 33, 36 of the transport system 19. In this way, a stored, unprepared material roll can be taken out again and, prepared via the transport track 36, can be passed to the inner shelf block 24.

In the same way, in an advantageous further development of the present invention, the transport system 19 has a transport track 43, which is different from at least the transport track 33 or 36, and on which transport track 43, material rolls from a storage space 44, such as, for example, in the form of a transfer station 44, of the inner or center shelf block 24 can again be placed on the transport tracks 31, 33, 36 of the transport system 19. In this way, an unprepared material roll, which was stored in the inner or center shelf block 24, can be taken out again and, after being prepared via the transport track 36, can be passed back to the inner shelf block 24.

Now, the serving element 29, which is arranged between the outer shelf block 22 and the inner shelf block 24, takes over the material roll delivered to the storage space 32 and redeposits it, for example, on a free storage space 26 of the outer shelf block 22. As a rule, the outer shelf block 22 has only unprepared rolls. However, in exceptional situations, the outer shelf block 22 can also be used as a buffer for previously prepared rolls. This can be the case, for example, if a long production pause has been used for material roll preparation and/or if a large production is planned.

If there are certain logistic reasons, or if the outer shelf block 22 is already fully stocked with unprepared rolls, the serving element 29 now takes up the delivered, for example the unprepared material roll, and deposits it on a storage space 28 of the inner or center shelf block 24. In this case, the inner shelf block 24 is used as a buffer for unprepared material rolls. Thereafter, for the purpose of preparing material rolls, these can be taken, by the serving element 29, from the storage space 28, again via the storage space 42 of the outer shelf block 22, to the transport track 19, and thus to the unpacking station 38 and/or to the glue preparation station 38.

The serving element 30, which is arranged between the inner shelf block 24 and the outer shelf block 23, and next to the roll changer 06, is also configured for serving both adjoining shelf blocks 23, 24. For example, serving element 30 now takes over an already prepared material roll, which was delivered to the storage space 39, and redeposits it, for example, on a free storage space 28 of the inner or center shelf block 24. In accordance with the above discussion, the inner or center shelf block 24 can contain prepared, as well as unprepared material rolls. However, it can also only contain prepared material rolls, if, for example, a large production is planned. In exceptional cases, only unprepared rolls can be stored if, for example, an extended production pause is imminent and/or if a respectively large delivery has taken place.

It is now possible, by the use of the serving element 30, to redeposition unprepared material rolls from the storage space 34, on, for example, a free storage space 28 of the inner shelf block 24, or on a free storage space 27 of the shelf block 23 which is closest to the roll changer 06.

If certain logistic reasons exist, in exceptional cases it is possible by use of the serving element 30, to store unprepared material rolls from the inner or center shelf block 24, for example from the storage space 34 or from a storage space 28, in the shelf block 22 which is nearest to the roll changer 06, for buffering.

However, basically the inner or center shelf block 24 is used for buffering with prepared and with unprepared rolls, so that preferably only unprepared rolls are stored in the outer shelf block 22 which is located remote from the roll changer 06, and prepared rolls are stored only in the shelf block 23 which is close to the roll changer 06. Together with parts of the inner or center storage block 24, the outer storage block 22 functions as a main depot, and the shelf block 23 close to the roll changer 06, together with parts of the inner or center shelf block 24, functions as a so-called day storage.

A further transport system 46 is provided between the outer shelf block 23 and the roll changers 06, by the use of which, material rolls can be removed from the outer shelf block 23 and can be taken to the, or to one of the roll changers 06. The transport system can basically be embodied in any desired way, such as, for example, with fork lifts, with "driverless transport systems (FTS), as track-bound vehicles or as those with tires, either manned or unmanned. However, it is advantageous if the transport system is configured without drivers and receives its tasks from a higher-order guide system and/or a control system, such as, for example, from the material flow system 05, or from an assigned roll changer 06.

In the example shown in FIG. 2, an inner supply circuit 47, which is embodied as a track-bound transport system 47, such as, for example, as driven track-bound transport carts with appropriate guide devices, is assigned to each roll changer 06. Storage spaces 48, which are used for transfer or deposit, and which are, for example, deposit spaces 48, are assigned to this inner supply circuit or transport system 47 in the shelf block 23.

In the above-mentioned embodiment of the present invention, with a defined deposit space 48 per roll changer 06, the material rolls, which are needed or ordered by the respective roll changer 06, are supplied by the serving element 30. These material rolls can be taken from the storage spaces 27 in the shelf block 23 or from the storage spaces 28 of the inner shelf block 24. In special cases, the serving element 30 can take a roll directly from the transfer space 39 and can place it in the deposit space 48.

In an embodiment of the present invention, which is not specifically represented, the removal of the required material roll can also take place by use of a transport system 46, wherein the transport then is performed, for example, by transport means, such as, for example, by a manned fork lift or FTS, which is not assigned to a single roll changer 06. In this case, it might not be necessary to define fixed deposit spaces 48 for the individual roll changers 06. In such a transport system, a transport system can supply itself, upon demand, from one of the different storage spaces 48 intended for the deposit, for example. If, in a further development, all or some of the storage spaces 27 should be accessible from both sides, the material rolls meeting the requirements can be directly taken from the shelf block 23 by the transport system.

Figure 3:
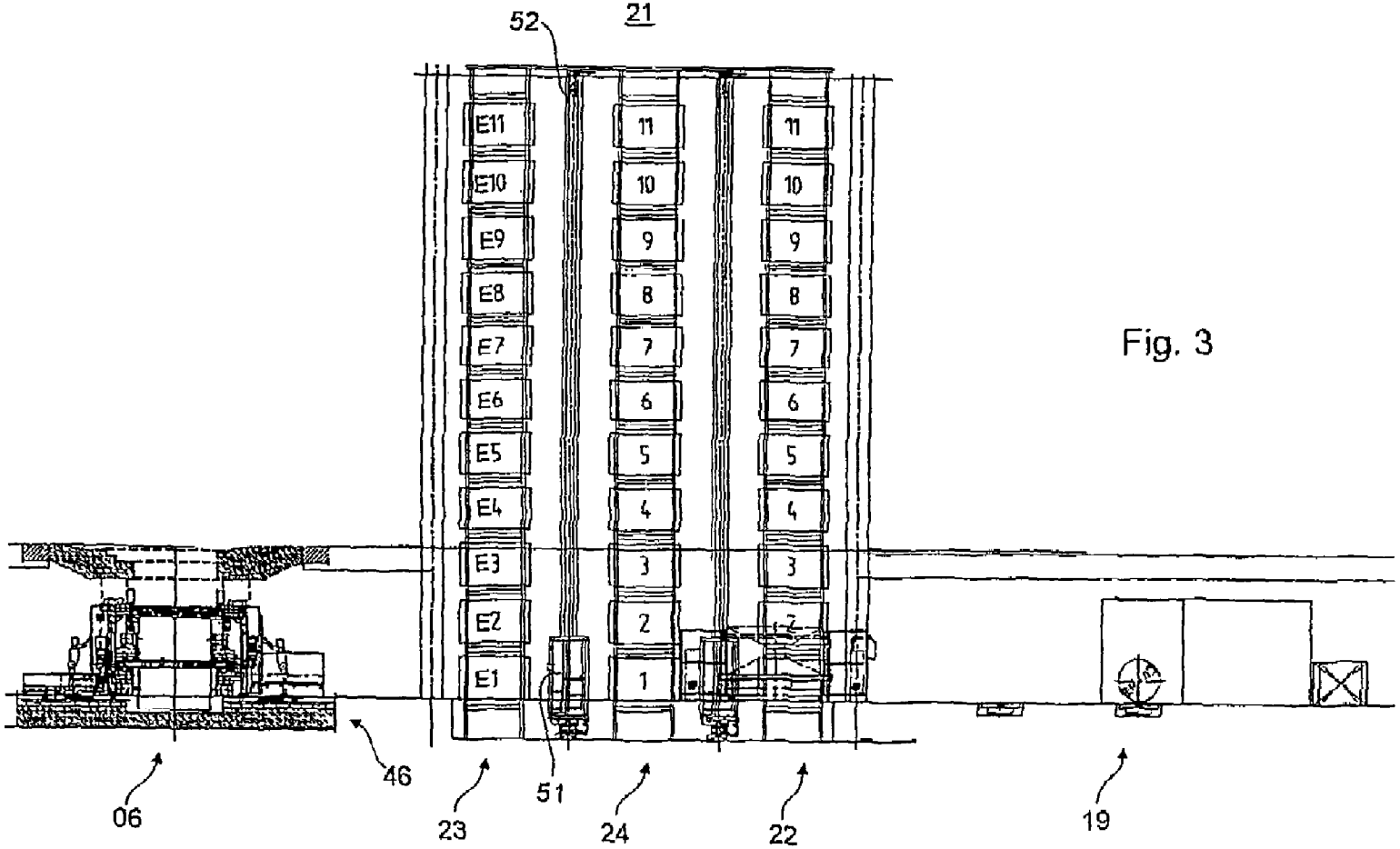

The shelf serving elements 29, 30 are preferably configured as shelf serving elements 29, 30, as represented in FIG. 3. A gripping and/or lifting mechanism 51 is arranged on a vertically extending mast or support 52 and is driven in such a way that it can be moved in the vertical direction from a storage space of a lowermost level E1 of the respective shelf block 22, 23, 24 to a storage space on an uppermost level E11. The support 52 is seated or is secured in the lower area and in the upper area of the depot 21 and is driven in such a way that it is horizontally movable in the longitudinal direction of the corridors. The gripping and/or lifting mechanism 51 can, in turn, be moved with respect to the support 52 by rotation and/or in a linear movement in the horizontal direction and can be driven in such a way that it can pick up rolls from the two adjoining shelf blocks 22, 23, 24, or can deposit rolls there. It can be further seen, by referring to FIG. 3, that the inner shelf block 24 only includes a single storage space 28, 34, 39, 44 over its width, which single storage space is accessible to the respective serving element 29, 30 from both sides of the shelf block 24.

In the course of selecting a roll or of selecting the storage space 27 or 28 by the serving element 30 and of selecting the following deposit at the storage space 48, demands made on geometry and/or quality of the desired roll are taken into consideration. This also applies to the example not shown with the direct access to the storage spaces 27 by an alternative transport system 46.

It is advantageous to provide at least one depot management system for this purpose, in which the exact knowledge of the actual occupation of the storage spaces 26, 27, 28, 32, 34, 39, 48, together with knowledge of the specific properties of the rolls, and in which of the storage spaces 26, 27, 28, 32, 34, 39, 48 the rolls, with the appropriate properties, are memorized. In an advantageous embodiment, specific roll data are collected in the area of the stock reception arrangement, or possibly in the area of the roll preparation and are assigned to the respective roll. Then the depot management system has information at all times regarding the storage of specific rolls in the depot 21.

In a particularly advantageous embodiment of the present invention, the depot 21, together with the depot management system, the stock reception arrangement 18 and at least the outside transport systems 19, 45, or those systems which are located outside the depot 21, are integrated into a material flow system 05, which is connected with the management level 11 and/or with the production planning system 03. If the serving elements 29, 30 are not directed by a depot management system, the function of depot management and the dissemination of orders to the serving elements 29, 30 can also take place via the material flow system 05, if required.

A particularly effective management of the material rolls, the optimized storage of the material rolls in the shelf blocks 22, 23, 24 and an efficient transfer of the material rolls to the roll changers are possible by the integration of the separate systems into a material flow system 05.

The above-described material supply system 02, the configuration of the depot 21, for example together with all or with some of the transport tracks 31, 33, 36, 42, 43, is of particular advantage in connection with printing presses 01 having several sections A, B, as depicted in FIG. 1. The material supply system 02, or the configuration of the depot 21, are advantageous particularly when several printing presses 01 are arranged in series in the manner of a printing press installation, such as represented in FIG. 2, for example.

The depot 21 extends over the entire length of the two printing presses 01. The shelf block 23 which is closest to the roll changers 06 substantially extends over the entire length of the printing presses 01 from the first to the last roll changer 06. In the depicted example, the inner shelf block 24 extends over the same length. In order to make possible a direct access from the stock reception arrangement 18 to the inner or center shelf block 24, the outer shelf block 22, which is closest to the stock reception arrangement 18, is made shorter in length. It is essentially placed symmetrically with respect to the two printing presses 01 to be supplied with material rolls. In the depicted example, the material supply system 02 has two areas for use as the stock reception arrangement 18, which two areas 18 are connected via respective transport systems 19 with storage spaces 32 in the areas near the end of the shelf block 22. Several serving elements 29, 30 are provided in the corridors between two respective ones of the shelf blocks 22, 23, 24.

The configuration of the depot 21 represented, in particular in connection with the printing press installation, makes possible a particularly flexible supply of the printing presses 01. Not only is a buffer function achieved by the use of the inner shelf block 24, but the supply of a printing press 01 with material rolls from an area of the depot 21 can take place, which area is located at the level of the other printing press, and vice versa.

In principle it would be possible to provide several inner shelf blocks 24, which then would each have only one storage space over their width or depth. A serving element 29, 30 is then respectively arranged between each two of the respective shelf blocks 22, 23, 24.

In the simplest case, the stock reception arrangement 18 consists of a transfer position to the automatic roll supply and of an input possibility for entry of the roll entry information. However, optionally it is advantageous not to perform the unloading of rolls from a truck, train or ship with the fork lift, but instead to automate it. Here, a differentiation between three basically different models can be made:

a) horizontal transport of the paper rolls and rolling of the rolls over their circumference, b) upright transport of the paper rolls on a truck/railroad car/ship provided with rails on the bottom, c) upright transport of the paper rolls on a special truck/railroad car/ship, which have a type of conveyor belt on the loading area.

A material roll separation device can be assigned to the stock reception arrangement 18. As a rule, rolls of half or of one quarter width are transported upright on top of each other. In this case, it is necessary to separate the rolls, i.e. to lift the upper roll and to place it next to the lower roll.

Accidents can occur in an automatic system if the goods to be transported do not have the expected shape. It is therefore practical to ascertain that the exterior shape of the material rolls is maintained within certain limits and to additionally assign a contour check function to the stock reception arrangement 18. In connection with paper rolls, systems using photoelectric barriers, photoelectric gratings or area scanners are offered, to which systems a more or less intelligent evaluating device is connected.

It is furthermore of advantage if the delivered material roll is identified, in the area of the stock reception arrangement 18, by, for example, a bar code detector, such as, for example, by a bar code reader 53, or by another system. The bar code label is used for identifying the roll and is detected by the system.

For the horizontal storage of, for example, prepared or unprepared rolls on several levels E1 to E11, the depot 21 is configured as an upright shelf depot 21. Basically, the upright shelf depot 21 can also be capable of receiving pallets or rolls which are stored upright. However, if the rolls are stored upright, for example in the main depot 21, at least the serving elements 29, 30 or the transport system 46 must make tilting or reorientation of the rolls possible, or a tilting station may be arranged between the depot 21 and the roll changer.

As a rule, a preparation circuit 35, as seen in FIG. 2, has the unpacking station 37 and the glue preparation station 38, which station 38 is, for example, configured as an automatic glue preparation device. Added to this, if desired, are transfer positions in the transport system 19. The unpacking station 37 has facilities, for example, on which the paper rolls can be aligned and can be semi-automatically unpacked. Furthermore, at this location, the bar code can be picked up for checking, for example with a hand scanner, the diameter can be determined and the material roll can be weighed for checking. The glue preparation station 38 represents an automatic glue preparation system, for example. A suitable glue preparation station 38 can typically process approximately 15 rolls per hour.

When stocking the depot 21, and in particular when stocking the outer shelf block 23 and parts of the inner or center shelf block 24 with prepared rolls, it should be noted that the glue preparation is usable or is viable for only a limited time, at present for 8 to 12 hours, for example, and must then be renewed. In the depot 21, it is possibly also necessary to handle roll remnants on loading aids, which were returned from a roll changer 06, as well as to handle the loading aids themselves.

A roll changer 06 has, for example, two pairs of support arms for receiving paper rolls. A section of a transport track is assigned to each roll changer 06, on which section of transport track a paper roll for the roll changer 06 can be deposited. In this case, the roll changer 06, with its buffer position or deposit space is also called an inner supply circuit 47, for example, and is a part of the printing press 01, or is assigned to it. It is used for rolling off the paper rolls and for accomplishing an automatic roll change with gluing.

For material roll transport over extended horizontal distances, such as between the stock reception arrangement 18 and the depot 21, plate or belt-and-plate conveyors are frequently employed, and which function in a manner similar to a conveyor belt. For material roll transport over distances between the stock reception arrangement 18 and the depot 21, or between the depot 21 and the printing press 01, it is also possible to employ transport systems 19, 46 which, for example, are configured as driverless corridor transport vehicles. However, within the preparation circuits 35 and within the inner supply circuits 31, track-bound transport systems 19, 46 are employed, typically driven, track-bound transport carts that are provided with appropriate guide devices. In small to medium installations, it is possible to realize the entire roll transport by the use of such track-bound transport carts.

The movement control of the transport systems 19, 46 is provided, in an advantageous further development, by a control device that is assigned to these transport systems 19, 46, such as, for example, a memory-programmable control device, in particular an SPS configurator, including an operating panel by the use of which, drive orders can be configured or, in an advantageous embodiment, by the use of a computer unit that is assigned to these transport systems 19, 46, such as, for example, by a vehicle guidance computer.

The roll supply system 02 should be capable of providing a printing press 01, or of providing a printing press installation with one or several lines of presses, each of which can consist of several sections A, B, with prepared paper rolls in a sufficient and timely manner. It is furthermore desirable for the roll supply system 02 to be capable of working from roll requests and from return orders from the roll changers 06. Ideally, the roll supply system 02 is capable of determining the actual paper requirements on the basis of production data provided by the product planning system 03, and also on the basis of actual press parameters actually provided by the press management level 11. "Nominal" production data, which change in the course of production, should be taken into consideration.

To meet the above-mentioned demands, the print shop, together with the depot 21, has the above-mentioned material flow system 05 for use in planning, coordinating and controlling the flow of material in the print shop. In an advantageous embodiment of the present invention, the material flow system controls and manages the entire flow of material in the installation and is of a higher order than the subsystems, such as the transport system or systems 19, the transport system or systems 46, and possibly further than the transport and preparation systems of the roll supply system 02. It includes, besides the direct material roll supply, the handling of the stock reception arrangement 18 and the management of the depot 21. If the depot 21 is provided with its own depot management system in the form of a subsystem, the material flow system 05 has at least one interface with this depot management subsystem.

The material flow system 05 receives information regarding planned and current production via, for example, a signal connection from the higher-order product planning system 03 and/or from the printing press 01, and in particular from the management level 11 of the latter. These data are processed in the material flow system 05, and the individual orders are forwarded to the above-mentioned subsystems. Movement control, or the working off of the order itself, preferably takes place in the control device which assigned to the subsystem, and is at least partially autonomous.

Because of its topology and because of the transport tracks, the above-described depot 21 is not primarily intended for keeping a multitude of different articles available for rapid access, such as is the case with a consignment depot, or to store large amounts of the same article for successive access, such as a storage device. Instead, it is intended for receiving the planned requirements of materials for a pending production period and to deliver them in the correct way for a production to the press 01, in a manner of a buffer storage.

The stored material rolls can be stored in the delivered state or unprepared and are prepared in the depot 21 for use in production by appropriate devices and methods, in the preparation circuit 35. The production preparation substantially relates to unpacking and to preparation for automatic gluing, as has been discussed previously.

Advantageously, the depot 21 is provided with an automatic stock reception arrangement 18, or with an automatic storage track, such as transport tracks 31, 33, 36, by the use of which, truck loads can be automatically serviced, or on which rolls can be randomly manually placed. In this area, the shape of the stored material is checked, defective rolls are removed as required. Additionally, the rolls are automatically separated by use of a suitable device, if needed, are identified by bar code readers 53 and are transported to the storage space of the respective storage block 22, 23.

The storage spaces are configured in such a way that paper rolls of a defined minimum diameter can be transported by use of the respective serving elements 29, 30, or by the transport system 19, and can be stored in the storage spaces 26 to 28, 32, 34, 39, 48. In this way, the handling, the making available and the managing of loading aids such as pallets, for example is are avoided.

For paper rolls which fall below the defined minimum diameter, the depot 21 can have loading aids, such as, for example, in an area of storage places which are specially provided for this and which are located in the outer shelf block 23, which faces the processing machine.

Ideally, the depot 21 is configured and is equipped in such a way that rolls of material, which were stored in the delivered state, can be automatically serviced in the unpacking and preparation circuit 35. The unpacking and preparation circuit 35 is a part of the depot 21 and is equipped with fully automatic, with semi-automatic or with manually operated devices for unpacking, such as unpacking station 37 and for gluing preparation, such as glue preparation station 38. The operation of the depot 21 is optimized so that manual intervention is minimized to as large an extent as is possible.

The advantages of the configuration of the depot 21 are used, in particular together with a corresponding method, for storage with a corresponding storage strategy. This method is characterized so that the storage of the material rolls in the depot 21 is already controlled and is optimized to the requirements of the pending productions. This is achieved by the provision of an interface with the product planning system 03, through which interface the data regarding the pending production are transmitted. This information is processed in the material supply system and the rolls for storage, in particular the unprepared rolls, are requested on the basis of these data. This request can be prepared from a list of requirements in paper form, from an indicator display or by the use of communications with an upstream located storage area, or reservoir with its own depot management, or by a rapid delivery by truck.

To find the optimal time period for production preparations, the method or the logic implemented in the material supply system takes at least the limited effectiveness of the glue preparation into account, which limited effectiveness must be matched to the planned production period. In addition, preferred preparation times can be advantageously taken into account in the logic. These can be windows of time in which no or only little production occurs, in order to achieve a balanced use of the depot vehicles and/or they can be windows of time during normal daylight working hours in order to avoid the payment of bonuses which are required for shift or for night work, thereby optimizing the cost.

The method of the material supply system is implemented in such a way that the available storage space can be used, and is optimized in regard to the actual requirements. This means that with rapidly changing productions, it is necessary to keep a plurality of different articles, such as rolls of different dimensions and/or of different quality available and which articles can be redistributed in accordance with production planning in the storage area near the presses, for example in the shelf block 23, in order to achieve a large material through-put In connection with long or lengthy productions, in particular production occurring at night or on the weekend, it is necessary to keep a large amount of identical articles available and to match the production preparation optimally to the process in order to be able to evenly supply the installation during such long production periods.

The method of the material supply system can also be advantageously configured to assure the provision of the production installation with material to the greatest extent also in the case of incidents, such as, for example, the loss of the preparation circuit 35, an unplanned requirement for a type of roll which is not in the depot at the time, a pass through, or in the case of the delivery of a similar article, if the required one is not available. In the case of the loss of the higher order material supply system 02, the method of the present invention provides the option of a configurator operation, for example.

Figure 4:
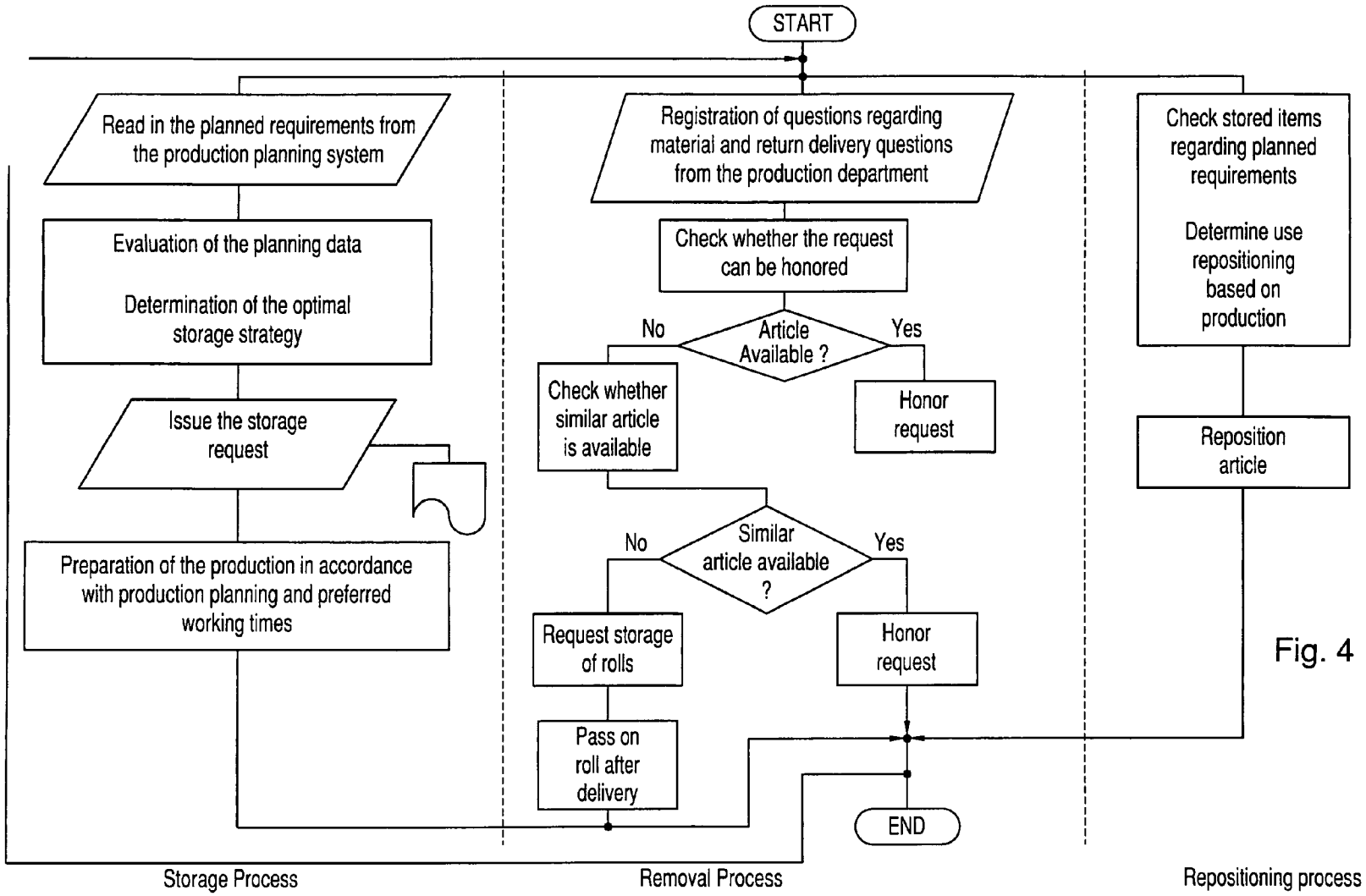

The method of the material supply system is based on the provision of parallel or of approximately parallel running processes for storage, for redepositioning and for serving the press 01. FIG. 4 shows this in a rough flow diagram.

In the left branch or storage process, the planned requirements from the production planning system 03 are read in by the logic on which the material management system 02 is based or by the software. Subsequently, these data are evaluated in view of an optimal storage strategy. This evaluation is based on the special configuration of the depot 21, consisting of the two outer and the inner storage blocks, together with the serving elements 29, 30, the preparation circuit 35 and the transport system 19, by the use of which, unprepared, as well as prepared rolls can be stored and can be redeposited in the depot 21. Although there is basically a gradient or a progression from unprepared rolls to prepared rolls from the stock reception arrangement 18 to the press 01 in the shelf blocks, a path of an unprepared roll "backwards" from the inner shelf block 24 to the outer shelf block 25, which is remote from the press 01, or to the preparation circuit 35 is also possible, in contrast to conventional systems. The determination of the storage strategy in accordance with the present invention is represented somewhat more specifically in FIG. 5.

In the sub-process for determining the storage strategy, identified as "determination of the optimal storage strategy" in FIG. 4, the requirements for paper rolls or for rolls of material are first determined, and an alignment or a comparison with the existing inventory is made. Depending on the result, in the case of a deficit, the requirement for the additional storage of fresh rolls, from trucks, railroad cars or a storage facility in the depot 21, is determined.

Parallel with this determination, the expected occupation of the depot is determined as a further criteria affecting the storage strategy. If it is low, the shelf block 22 remote from the presses is used only for unprepared rolls, while the shelf block 24 close to the presses is kept empty as much as possible, except for passing rolls through it. If the occupation of the depot is normal, the shelf block 22 remote from the presses is again used solely for unprepared rolls, the shelf block 23 close to the presses is used only for prepared rolls, but the inner or center shelf block 24 is used as a buffer for both unprepared material rolls and for prepared material rolls. The same process occurs with the occupation of the depot high. What will be discussed below can be applied to the criteria "high", "normal" and "low".

The type of requirement is added as a further criteria, wherein a differentiation is made between many small productions following each other and a few large productions. In the first case, it is necessary to keep sufficient spaces clear for returns of previously opened material rolls from the roll changers 06 to the depot 06. In the second case, the priority lies in the path-optimized storage of unprepared and of prepared material rolls.

Further advantageous influential criteria for forming the storage strategy in accordance with the present invention are represented by the time plan for stored fresh material rolls in the depot 21. Here, a differentiation is made between the intended material roll storage time periods during and outside of normal work times. In the first case, the storage of fresh rolls preferably takes place, if the capacity is sufficient and if the planned period of time until the intended use is not too long, via the preparation circuit 35 for preparation before the material rolls are taken to a shelf block 22 or 24. In the second case the rolls are stored unprepared, such as, for example, packaged and without glue preparation and are prepared later during normal working hours.

The results of the partial strategies or criteria are now evaluated and the storage strategy is set. In variations, only a partial number of the partial strategies may be used. If, in the case of a more extensive depot 21, several inner or center shelf blocks 24 exist, the strategies should be correspondingly widened to cover shelf blocks which are "closer to the presses", "innermost" and well as "farthest away from the presses".

After setting the storage strategy, the issue of the storage request takes place, which is followed by the production preparation, taking into consideration the production planning and possibly the preferred preparation times.

In a parallel process, which is a removal process, material and return requests are registered by the press 01, such as, for example, in the roll changer 06 and are checked to determine whether they can be met. If yes, the request is met. In an advantageous embodiment of the present method, in the case of a shortage, it is provided to check the stock for similar roll types or articles and, in the case of a positive result, to provide the press 01 with them. Otherwise, for example, the immediate storage of a roll of matching type takes place, which roll, in this case, should be passed through as quickly as possible from the stock reception arrangement 18, by way of the preparation circuit 35, the inner or center shelf block 24, as well as the shelf block 23 which is close to the presses. In an advantageous embodiment of the present invention, the definition, which is for the decision to be made in FIG. 4 regarding a "similar article" or roll, is stored in a table.

In the third, parallel occurring process, which is a redepositioning process, the depot occupation is continuously checked with respect to the planned needs in such a way that the prepared and the unprepared rolls of the various material roll types are optimally positioned with respect to the anticipated production. This means that the rolls which will be required in the immediate future should, as a rule, already have been prepared and should at least be located in the inner or center shelf block 24 or in the outer shelf block 23 which is close to the presses. In this case, in the immediate future, or at short order, should be understood to mean a minimum lead time, which lies a quarter hour, or better yet, which lies or extends a half hour ahead of the expected time the roll of material is required at the deposit space 48. These material rolls should be located in the direct pickup area of the serving elements 30, which area is close to the presses. The roll that is immediately required for the roll changer 06 should have already been delivered to a deposit space 48 corresponding to that respective roll changer 06. The window of time for this delivery should be at least 0 to 5 minutes prior to the call-up of that roll by the roll changer 06. In the depot area which is remote from the presses, for example in the pickup area of the serving element 29 remote from the presses, the preparation and storage of material rolls, which will be required over a medium period of time, takes place. For example, it is possible in this time period to take unprepared rolls from the outer shelf block 22 remote from the presses or from the inner or center shelf block 24 and to feed them to the preparation circuit 35 before they are then placed into intermediate storage in the inner or center shelf block 24 as prepared rolls. They are then accessible to the serving element 30 which is positioned close to the presses and can thus be called up in a short time period. In accordance with the planned requirements, a production-oriented redepositioning of unprepared and of prepared rolls in the depot 21 takes place in the third partial process. The determination of the redepositioning strategy is shown in greater detail in the flow chart depicted in FIG. 6.

The redepositioning strategy, which is identified as the "useful production-oriented redepositioning" in FIG. 4 is determined in the partial process, identified as "redepositioning," in that initially the storage capacity is determined and a differentiation is made between low, normal and high storage occupations. As a function of this determination and differentiation, in the case of low occupancy, the rolls are stored in a path-optimized way under the premise of minimal redepositioning, a premise that redepositioning should be avoided if possible. With normal occupancy, the rolls are stored in a path- and space-optimized way, wherein needed redepositioning is permissible. With high occupancy, the rolls must be stored in a space-optimized, wherein redepositioning takes place in accordance with production requirements. Optimization, with regard to path and/or to space and/or to the number of redepositioning processes, can take place by the use of mathematical algorithms, which search for states of a local or an absolute minimum for the respective, possibly weighted variable or variables, while taking marginal conditions into consideration. This can take place while considering only the next step, such as, for example, the movement of a single roll, but in an advantageous, forward looking manner can take place by considering several pending storing and/or removal processes, so that an optimized strategy is developed as a whole. In the ideal case, the entire upcoming production period is included in the determination of the strategy so that, even if individually observed redepositioning steps, occurring within a short period of time, and considered by themselves, such as, for example, at the start would not represent an optimal solution, the entire process, as a whole, results in an optimal run.

For example, "path-optimized" should be understood as meaning that a roll, which is suitable for a roll changer 06 and which is already prepared, is stored as closely as possible in the deposit space 48 assigned to the roll changer 06, such as, for example, directly to the left or right of it. This pure form of a strategy is possible, in a simple way, with a low utilization or occupation of the depot 21, for example at least below 50%, and in particular at less than 40%.

With increasing utilization or normal occupation, such as, for example, at greater than 50%, a purely "path-oriented" strategy becomes increasingly difficult because of the large occupation. Still empty spaces are occupied more and more in a "space-oriented" manner, i.e. randomly over the depot 21 in such a way, that increasingly more roll changers 06 must be supplied with a suitable roll via the center path. For example, the randomly stored rolls are distributed substantially evenly over the length of the depot 21 which corresponds to the roll changers 06 in operation.

If the utilization or occupation becomes high, such as at least greater than 60%, the strategy of the storage of either unprepared or prepared rolls takes place in a "space-oriented" manner, i.e. the rolls are randomly stored in the depot 21 over the length of the roll changers 06 which are operating and which must be supplied with rolls. In the extreme case, all storage spaces in the storage block 23 close to the presses, for example, are utilized.

The described partial processes, storage, removal and redepositioning processes, are preferably continuously iteratively performed. In this case, it is basically also possible to let the processes run not side-by-side or concurrently, but instead sequentially with continuous repetition.

The above-described depot 21 can be used, in particular, as a buffer storage 21 without the further requirement of an upstream located storage facility, since both unprepared, as well as prepared rolls of material are stored and managed in this depot 21. In that case, the delivery, such as the storage of unprepared rolls of material, can take place, for example, directly from the stock reception arrangement 18, such as from trucks, railroad cars, and the like. If, in one variation, a storage facility, used exclusively for unprepared rolls of materials, is placed upstream, an output of material from this storage facility is understood to be a "stock reception arrangement" 18 in the above-mentioned sense. The bar code reader 53, situated at the location depicted in FIG. 2 can be omitted, since information regarding the size and the quality of the roll to be stored in the depot 21 can be taken from the information which is already existing in the storage facility.

Figure 5:
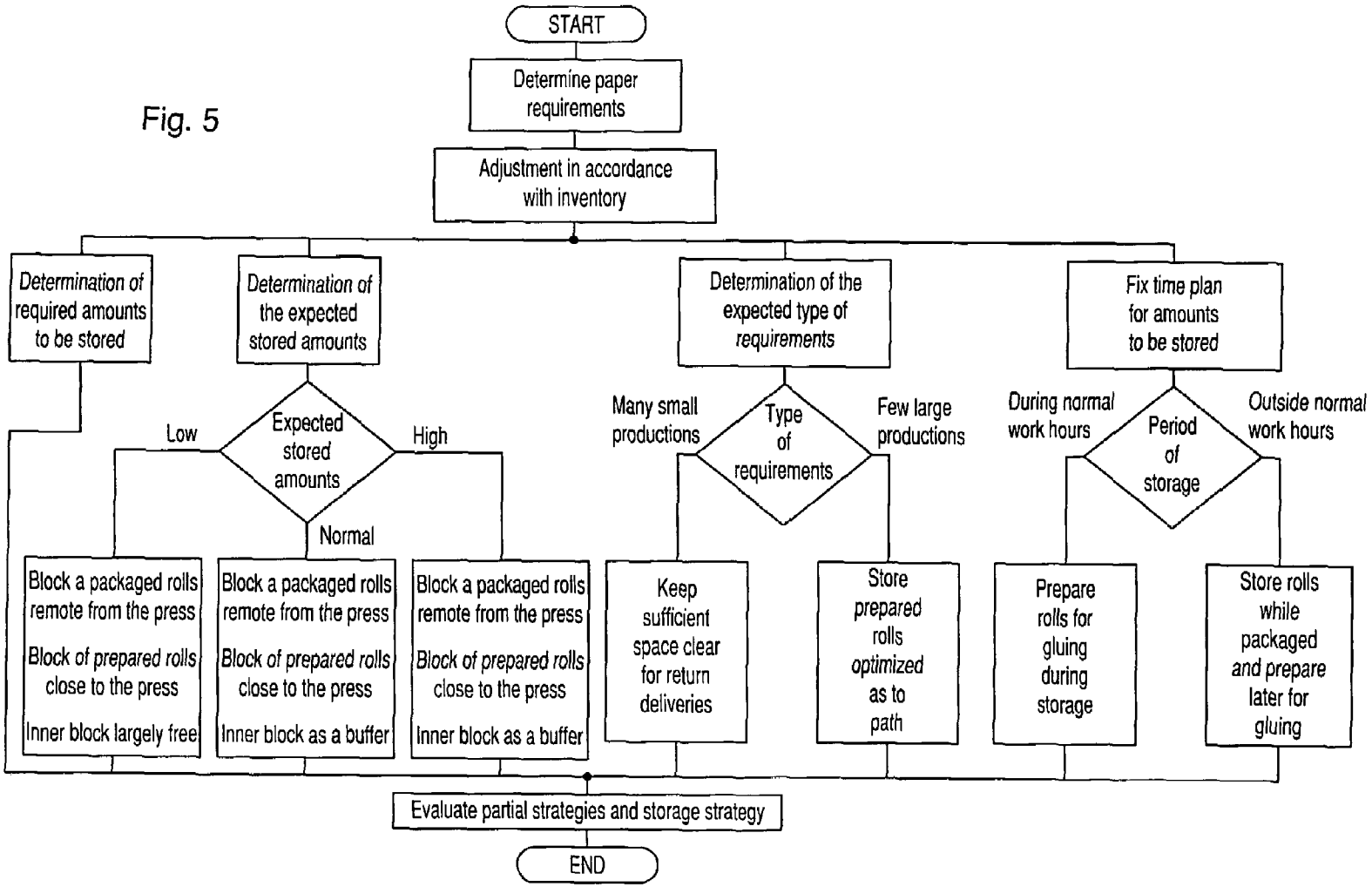
Figure 6:
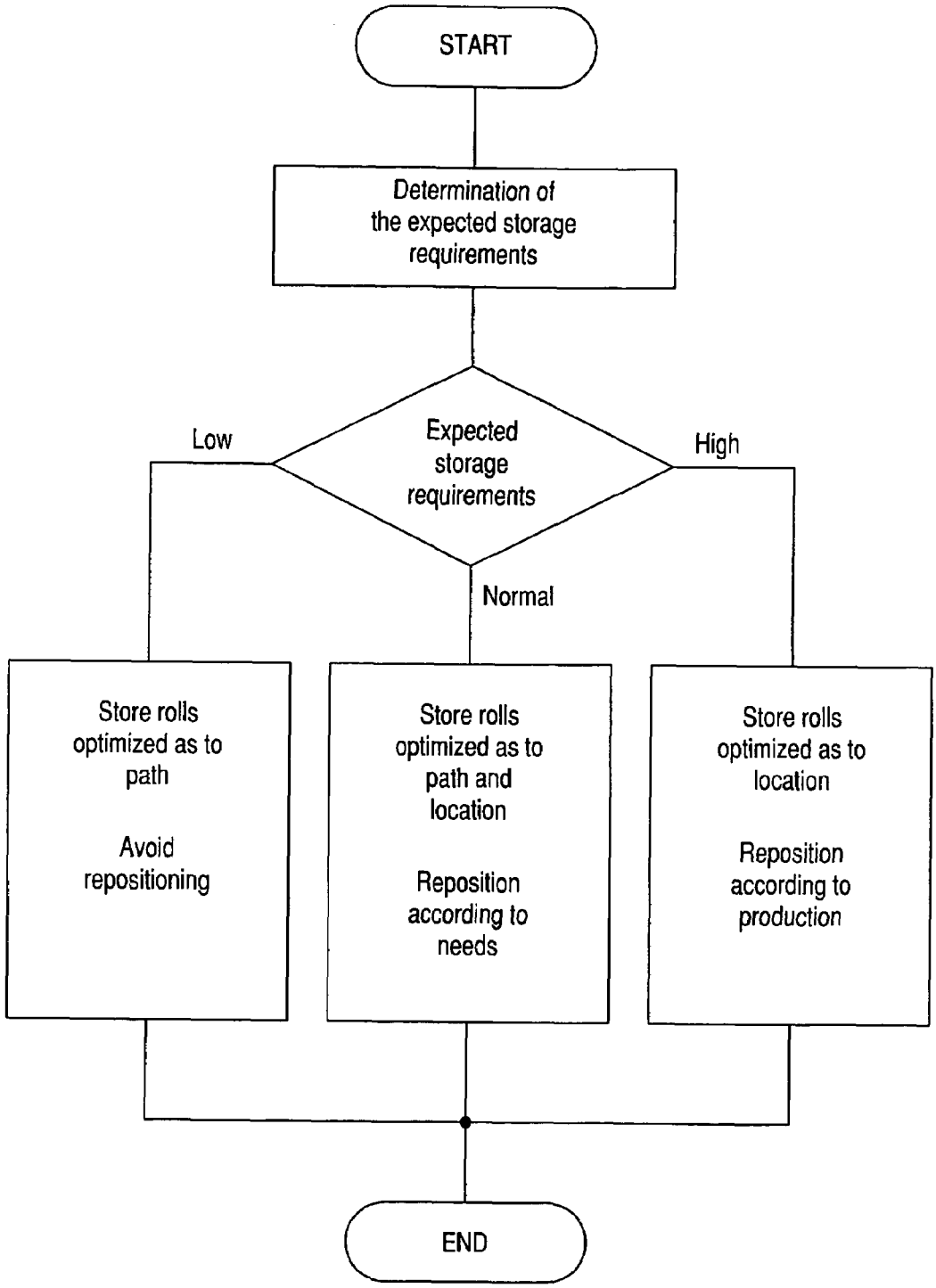

The criteria "high", "normal" and "low" and/or "many small", "a few large", as used in FIGS. 5 and 6, can each be stored as concrete threshold values, which are changeable, functionally or can be provided in table form, on the one hand. However, they can also be the basis of a fuzzy logic control. Depending on the total installation size of the presses and/or of the depot, the definition of these criteria can be differently stored and therefore should be changeable. In an advantageous further development of the present invention, the system, as a whole, or in parts, can also be embodied to be self-learning, so that the boundaries between the different modes of operation, or criteria, are displaced in specific areas by practical experience.

While preferred embodiments of a depot for material rolls, a material supply system and of methods for sorting material rolls, in accordance with the present invention have been set forth fully and completely hereinabove, it will be apparent to one of skill in the art that changes in, for example, the specific structure of the roll changers, the particular types of material roll transport systems, and the like could be made without departing from the true spirit and scope of the present invention which is accordingly to be limited only by the appended claims.

What is claimed is:

1. A depot for rolls of material which are intended for processing in a web-fed rotary printing machine, said depot comprising:

a web-fed rotary printing machine;

a first shelf block located remote from said web-fed rotary printing machine;

a second shelf block located adjacent said web-fed rotary printing machine, said first and second shelf blocks extending parallel to each other in a longitudinal direction;

a central shelf block located between, and spaced laterally from said first and second shelf blocks and extending parallel to said first and second shelf blocks in said longitudinal direction;

a first corridor extending longitudinally between said first shelf block and said central shelf block;

a second corridor extending longitudinally between said second shelf block and said central shelf block;

at least one storage space in said central shelf block and adapted to be filled and emptied with said rolls of material for use in said web-fed rotary printing machine from both longitudinal sides;

a first shelf serving element located in said first corridor, and adapted to fill and to empty said at least one storage space in said central shelf block and either the first shelf block or the second shelf block;

a second shelf serving element located in said second corridor and adapted to fill and to empty said at least one storage space in said central shelf block and an other of the first shelf block or the second shelf block;

a stock reception area for receipt of said rolls of material intended for processing in said web-fed rotary printing machine;

a roll of material preparation circuit usable to prepare said rolls of material for processing in said web-fed rotary printing machine;

a roll of material transport track extending from said stock reception area to said first shelf block, said roll of material transport track being outside of, and bypassing, said roll of material preparation circuit; and a preparation circuit transport track between said central shelf block and said roll of material preparation circuit.

2. The depot of claim 1 further including a second shelf serving element located in said second corridor, said at least one storage space in said central shelf block being adapted to be filled and emptied from both of said first and second corridors by said first and second shelf serving elements.

3. The depot of claim 1 wherein said at least one storage space can be filled and emptied directly from a first side by a transport system from said transport track and from a second side by one of said first and second said shelf serving elements.

4. The depot of claim 1 wherein said transport track is a direct transport track extending from said stock reception area to said central shelf block.

5. The depot of claim 4 wherein said direct transport track is adapted to transport unprepared rolls of material from said stock reception area to said central shelf block and bypassing said preparation circuit.

6. The depot of claim 1 further including at least two printing presses to which said depot is assigned.

7. The depot of claim 1 wherein said central shelf block has only one said storage space across a width of said central shelf block.

8. The depot of claim 1 wherein each of said first and second outer shelf blocks has only one storage space across a width of each said first and second shelf blocks.

9. The depot of claim 1 wherein a roll of material to be processed in said web-fed rotary printing press can be conveyed from said first corridor, located remote from said web-fed rotary printing press to said second corridor adjacent said web-fed rotary printing press.

* * * * *